US010240415B2

(12) United States Patent
Wolf et al.

(10) Patent No.: US 10,240,415 B2
(45) Date of Patent: Mar. 26, 2019

(54) ALIGNMENT ASSEMBLY

(71) Applicant: Schlumberger Technology Corporation, Sugar Land, TX (US)

(72) Inventors: John C. Wolf, Houston, TX (US); Luis A. Gonzalez, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 509 days.

(21) Appl. No.: 14/434,545

(22) PCT Filed: Oct. 10, 2013

(86) PCT No.: PCT/US2013/064254
§ 371 (c)(1),
(2) Date: Apr. 9, 2015

(87) PCT Pub. No.: WO2014/059090
PCT Pub. Date: Apr. 17, 2014

(65) Prior Publication Data

US 2015/0259995 A1 Sep. 17, 2015

Related U.S. Application Data

(60) Provisional application No. 61/713,363, filed on Oct. 12, 2012.

(51) Int. Cl.
*E21B 23/02* (2006.01)
*E21B 23/00* (2006.01)
*E21B 41/00* (2006.01)

(52) U.S. Cl.
CPC ..... *E21B 23/00* (2013.01); *E21B 23/02* (2013.01); *E21B 41/0035* (2013.01)

(58) Field of Classification Search
CPC ..... E21B 23/02; E21B 43/119
(Continued)

(56) References Cited

U.S. PATENT DOCUMENTS 4,349,071 A 9/1982 Fish
5,193,620 A 3/1993 Braddick
(Continued)

FOREIGN PATENT DOCUMENTS

RU 2073121 C1 2/1997
RU 2341639 C2 12/2008
(Continued)

OTHER PUBLICATIONS

International Search Report for International Application No. PCT/US2013/064254 dated Jan. 17, 2014.
(Continued)

*Primary Examiner* — Giovanna C. Wright

(57) ABSTRACT

A technique facilitates latching of a tool in a desired alignment within a tubing string. The tubing string comprises a latching section designed to latch the tool in a specific orientation. The latching section comprises a plurality of mounting regions designed to receive a plurality of profile inserts which are releasably engaged and interchangeable. The profile inserts may be arranged to create a key profile for engagement with a corresponding key associated with the tool. However, the profile inserts may be interchanged to change the key profile. Additionally, different combinations of profile inserts may be used to create different key profiles from one latching section to the next in tubing strings with more than one latching section.

14 Claims, 4 Drawing Sheets

(58) Field of Classification Search
USPC ..... 166/255.2
See application file for complete search history.

(56) References Cited

U.S. PATENT DOCUMENTS

| | | | | |
|---|---|---|---|---|
| 5,871,046 | A | 2/1999 | Robison | |
| 5,996,711 | A * | 12/1999 | Ohmer | E21B 7/061 166/255.2 |
| 6,012,526 | A | 1/2000 | Jennings et al. | |
| 6,202,746 | B1 | 3/2001 | Vandenberg et al. | |
| 2002/0112857 | A1 | 8/2002 | Ohmer et al. | |
| 2004/0011529 | A1 | 1/2004 | McGarian et al. | |
| 2004/0020648 | A1 | 2/2004 | Dewey et al. | |
| 2004/0262006 | A1 | 12/2004 | Dewey et al. | |
| 2009/0288879 | A1 * | 11/2009 | Arena | E21B 43/119 175/4.51 |
| 2010/0307770 | A1 | 12/2010 | Sponchia et al. | |
| 2011/0120731 | A1 * | 5/2011 | Robertson | E21B 23/02 166/382 |
| 2011/0186291 | A1 * | 8/2011 | Lang | E21B 47/024 166/255.2 |
| 2012/0103687 | A1 | 5/2012 | Saurer | |

FOREIGN PATENT DOCUMENTS

| | | | |
|---|---|---|---|
| SU | 1682532 | A1 | 10/1991 |
| WO | 2014059090 | A1 | 4/2014 |
| WO | WO2014126917 | A1 | 8/2014 |

OTHER PUBLICATIONS

Decsion on Grant in Corresponding Russian Patent Application No. 2015117489 dated Feb. 12, 2016, 15 pages.
Non-Final Rejection in related U.S. Appl. No. 14/767,547 dated Aug. 15, 2017, 12 pages.
Final Rejection in related U.S. Appl. No. 14/767,547 dated Jul. 30, 2018, 12 pages.
Search Report and Written Opinion of related International Patent Application No. PCT/US2014/015793 dated May 13, 2014, 15 pages.

* cited by examiner

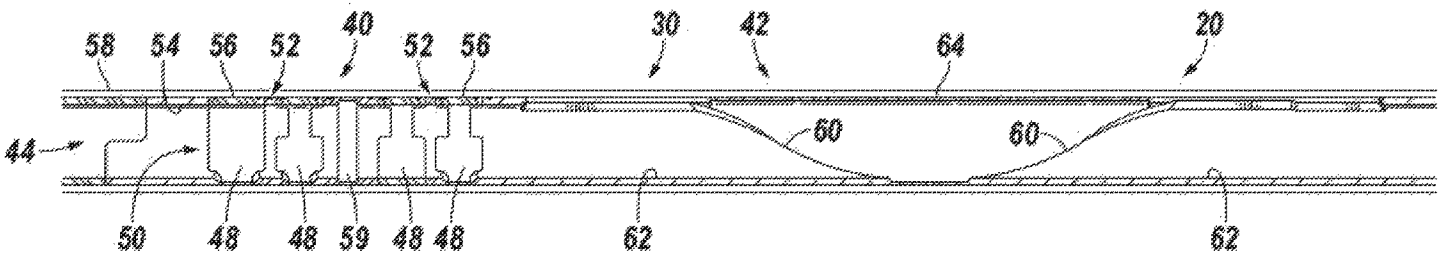
FIG. 2
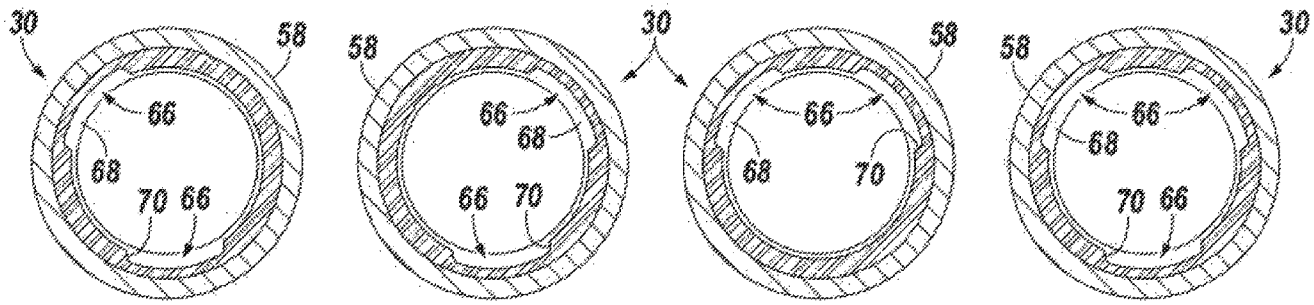
FIG. 3A
FIG. 3B
FIG. 3C
FIG. 3D

ALIGNMENT ASSEMBLY

BACKGROUND

In a wide range of oilfield service applications, various tools are located and/or oriented during construction of multilateral junctions. Sometimes a specific tool is selected for use at a specific lateral junction of a multilateral completion tubing string. Difficulties can sometimes arise in locating the tool at the desired junction. Additionally, certain applications use directional tools which are rotationally oriented. Such applications can again create difficulties in properly orienting and locating the tool for performance of a desired operation in a given procedure.

SUMMARY

In general, a system and methodology are provided to facilitate latching of a tool in a desired alignment within a tubing string. The tubing string comprises a latching section designed to latch the tool in a specific orientation. The latching section comprises a plurality of mounting regions designed to receive a plurality of profile inserts which are releasably engaged and interchangeable. The profile inserts may be arranged to create a key profile for engagement with a corresponding key associated with the tool. However, the profile inserts may be interchanged to change the key profile. Additionally, different combinations of profile inserts may be used to create different key profiles from one latching section to the next in tubing strings with more than one latching section.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and:

FIG. 2 is an axial cross-sectional view of a portion of the tubing string illustrating an example of the latching section combined with an orienting section, according to an embodiment of the disclosure;

FIG. 3 is a transverse cross-sectional view of examples of several cooperating profile inserts used to create a key profile, according to an embodiment of the disclosure;

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to aligning a tool within a tubing string. The system and methodology is useful in a variety of well related applications. However, the system and methodology also may be employed in many non-well related applications which utilize tubing strings and tools deployed through the tubing strings to specific locations for performing a given procedure. An example of a well related application is an intervention operation in a multilateral completion. In this latter example, an intervention tool is deployed down through a multilateral completion tubing string to a desired location.

At the desired location, a latching section of the tubing string is positioned to latch the tool in a desired alignment. The latching section comprises a plurality of interchangeable profile inserts which may be selectively inserted to establish a key profile specifically matched with a key associated with the given tool. In multilateral completion applications, for example, different key profiles may be established at different lateral junctions to ensure latching and alignment of the proper tool at a specific lateral junction for performance of a desired intervention operation. In some applications, the system comprises an orienting section which serves to rotationally oriented the tool prior to longitudinal movement of the key into the matching key profile. In such applications, the key profile may be designed to latch the key in both a longitudinal and rotational direction.

In a specific example, a tubing string is constructed with a latching section comprising a plurality of mounting regions. The mounting regions are designed to receive a plurality of profile inserts which are releasably engaged and interchangeable to facilitate easy assembly of a variety of key profiles. Depending on the type of tool deployed through the tubing string, the profile inserts may be arranged to create a specific key profile for engagement with a corresponding key associated with the tool. However, the profile inserts may be interchanged to change the key profile for different tools. Additionally, different combinations of profile inserts may be assembled at sequential latching sections to create different key profiles for use with different keys. In this manner, specific tools, e.g. specific directional tools, may be latched at specific locations along the tubing string.

Figure 1:
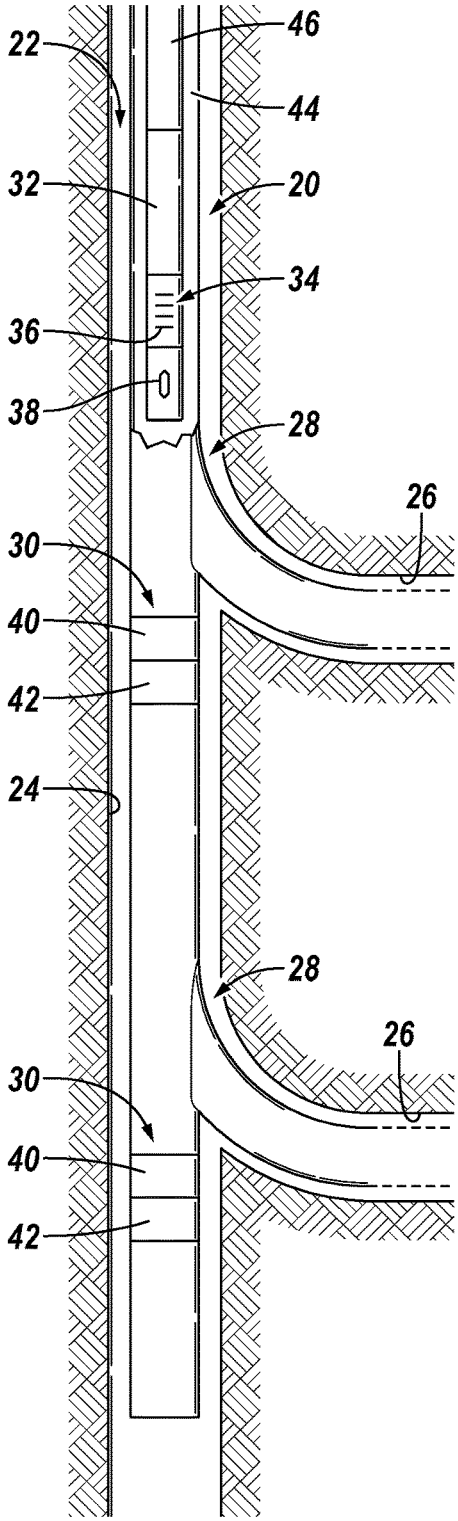
FIG. 1 is a schematic illustration of an example of a tubing string having a latching section for latching a tool in a desired alignment, according to an embodiment of the disclosure.

Referring generally to FIG. 1, an embodiment of tubing string 20 is illustrated. In this example, the tubing string 20 is deployed in a wellbore 22, such as a multilateral wellbore having a main bore 24 intersected by a plurality of lateral bores 26. By way of example, the tubing string 20 may comprise a multilateral completion tubing string having a plurality of junctions 28 which each provide access from the main bore 24 to a selected lateral bore 26. The tubing string 20 also may comprise a plurality of tubing sections 30, e.g. tubing modules, which are each designed to facilitate alignment of a tool 32 at a specific tubing string location. In multilateral well applications, tool 32 may comprise an intervention tool or other service related tool.

In the embodiment illustrated, tool 32 is associated with an alignment mechanism 34 which may be in the form of an orienting and locating assembly designed to orient and locate the tool 32 at the desired location along tubing string 20. The alignment mechanism 34 comprises a key 36 which corresponds with the tool 32 and is designed to locate and align the tool 32 at a desired location, as described in greater detail below. In some applications the alignment mechanism 34 may further comprise an orientation feature 38.

Each tubing section 30 of the tubing string 20 comprises a latching section 40 for latching with the corresponding key 36 so as to latch the appropriate tool 32 in a specific orientation. The latching section 40 of each tubing section 30 may be different from the other latching sections 40 to enable latching with specific tools 32, e.g. with specific intervention tools for performing intervention operations in the corresponding lateral bore 26. In certain embodiments, each tubing section 30 further comprises an orientation section 42 which is designed for interaction with the orientation feature 38 of alignment mechanism 34 to rotationally orient the tool 32. The rotational orientation may be performed prior to the ultimate longitudinal movement of key 36 into latching section 40 so that the tool 32 is rotationally oriented to a desired direction prior to latching of the key 36. In certain embodiments, the key 36 and the latching section 40 are designed to latch in both the longitudinal and circumferential directions to hold the tool 32 both longitudinally and rotationally.

The tool 32 may be delivered along an interior 44 of the tubing string 20 via a conveyance 46. In some applications, the conveyance 46 may comprise a flexible conveyance, such as coil tubing or slick line. When using a flexible conveyance 46, the orientation section 42 may be designed to cause rotation of the tool 32 relative to the tubing string 20 without applying torque to the conveyance 46. For example, the orientation section 44 may be designed to orient the key 36 and tool 32 through a longitudinal motion, such as a back-and-forth longitudinal motion.

Referring generally to FIG. 2, an example of tubing section 30 is illustrated. In this example, tubing section 30 may be in the form of a tubing module having both latching section 40 and orientation section 42. A plurality of profile inserts 48 is positioned in latching section 40 to create a key profile 50. Each profile insert 48 is interchangeable with other profile inserts which may be selectively substituted to create a different key profile 50. Individual profile inserts 48 or groups of profile inserts 48 may be interchanged with other profile inserts to create the desired key profile 50 which corresponds with a given tool 32.

The profile inserts 48 are releasably engaged with corresponding mounting regions 52 positioned along an interior of latching section 40. For example, the mounting regions 52 may be constructed on an inner tubing 54 and may be designed to receive corresponding mounting features 56 of profile inserts 48. In an embodiment, the inner tubing 54 has mounting regions 52 in the form of a plurality of spaces or openings sized to receive and hold the mounting features 56 in a manner which provides a longitudinal sequence of profile inserts 48, as illustrated. In some applications, the individual mounting features 56 and corresponding profile insert 48 may be inserted into the corresponding openings/mounting regions 52 from an exterior of inner tubing 54 and held in place by a surrounding body or housing 58. To interchange selected profile inserts 48, the inner tubing 54 is simply slid from outer body 58 to enable interchanging of the desired profile inserts 48 before the inner tubing 54 is moved back into outer body 58. In applications incurring high axial loading, the key profile 50 also may comprise an annular ring 59 disposed in inner tubing 54 to help absorb or counter the high axial loads exerted via key 36.

In the embodiment illustrated in FIG. 2, the tubing module 30 further comprises orientation section 42 which has a profile 60, or a plurality of profiles 60, designed to interact with orientation feature 38. By way of specific example, the orientation section 42 may comprise a pair of profiles 60 established by alignment mules 62 positioned to such that the profiles 60 face each other. In this example, a spacer sleeve 64 may be positioned between the alignment mules 62 to hold the alignment mules 62 at a suitable separation.

Once the orientation feature 38 reaches the space between profiles 60, the orientation feature 38 may be cycled back-and-forth, e.g. up-and-down, via conveyance 46 until the orientation feature 38 and the tool 32 are rotated to a desired angular orientation. After rotationally orienting the tool 32, the key 36 may be moved longitudinally into engagement with key profile 50. If the key 36 matches the key profile 50, the alignment mechanism 34 and thus tool 32 become latched. In the specific example illustrated, latching involves proper longitudinal and rotational positioning to allow engagement of key 36 with profile 50. Thus, latching secures tool 32 both longitudinally and rotationally with respect to the tubing string 20.

As further illustrated in FIG. 3, the longitudinal and rotational latching may be achieved by key profile 50 as established by profile inserts 48. FIG. 3 provides transverse, cross-sectional illustrations showing the four profile inserts 48 illustrated from left to right in FIG. 2. Although four profile inserts 48 have been illustrated for purposes of explanation, different numbers of profile inserts may be used to establish key profile 50, e.g. three or more profile inserts 38. In the example illustrated, the profile inserts 48 have engagement features 66 arranged to establish the key profile 50. The engagement features 66 may comprise longitudinal features 68 to secure key 36 longitudinally and circumferential features 70 to secure key 36 rotationally, thus latching the tool 32 longitudinally and rotationally. In some applications, the longitudinal features 68 and/or circumferential features 70 may be established at least in part by portions of inner tubing 54. It should be noted that either or both longitudinal features 68 and circumferential features 70 can be changed to change the key profile 50 by interchanging selected profile inserts 48.

Figure 4A:
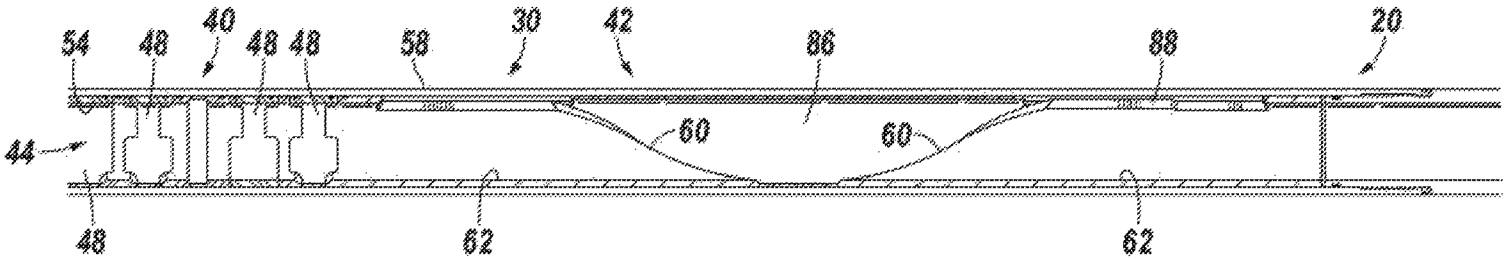
FIG. 4 is an exploded view illustrating an example of a tool combined with an associated key alongside of a portion of the tubing string having a latching section and an orienting section, according to an embodiment of the disclosure.
Figure 4B:
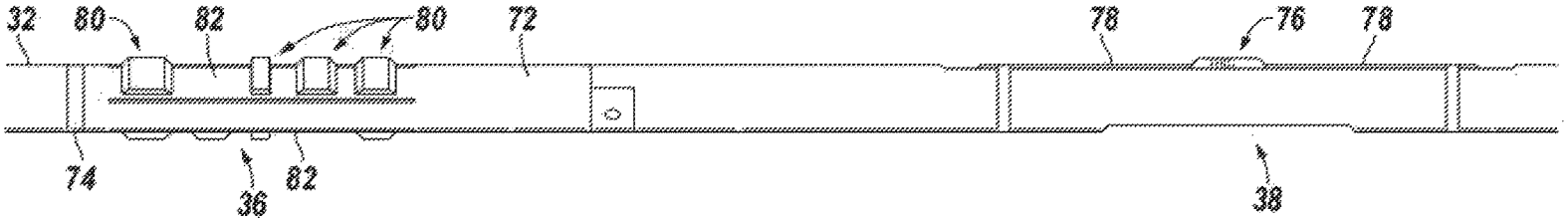

Referring generally to FIG. 4, an example of an alignment mechanism 34 is illustrated as being coupled with the tool 32. In this example, the alignment mechanism 34 comprises a body 72, e.g. a cylindrical body, having a connector end 74 designed for coupling with tool 32. The orientation feature 38 may comprise an orienting key 76 mounted to body 72. The orienting key 76 may be spring mounted in a manner which tends to resist radially inward motion of the orienting key and to spring bias the orienting key 76 in a radially outward direction to extend from body 72. In some applications, the spring bias may be established by mounting the orienting key 32 on a spring or a pair of springs 78, such as a pair of beam springs.

As illustrated, the key 36 may be in the form of a plurality of locating key members 80 mounted on body 72. Similar to the orienting key 76, the locating key members 80 may be spring mounted via a spring member 82, e.g. a cantilevered spring beam, to enable radially inward deflection. The ability to deflect orienting key 76 and locating key members 80 in a radially inward direction facilitates movement of the alignment mechanism 34 along the interior of tubing string 20 to the desired tool location. Once at the desired location, the orienting key 76 is moved radially outward via the spring bias to engage orienting profiles 60. Similarly, the locating key members 80 may be spring biased to a radially outward positioned to enable engagement of key 36 with key profile 50. It should be noted that in many applications the alignment mechanism 34 may be designed with an open internal passage which enables passage of fluid and/or equipment, such as intervention equipment.

In FIG. 4, an embodiment of the alignment mechanism 34 is illustrated as exploded from or separated from the tubing string module 30 of tubing string 20. By way of example, module 30 may comprise a selective lateral intervention completion module positioned proximate a lateral bore of multilateral well 22. Alignment mechanism 34 may be deployed along interior 44 of the module 30. In FIG. 4, however, the alignment mechanism 34 is illustrated as exploded or separated from the interior 44 to better illustrate the cooperating features of module 30 and mechanism 34.

When the alignment mechanism 34 is moved via conveyance 46 longitudinally downhole along interior 44 and into tubing string module 30, the orienting key 76 is consequently moved into a space 86 between orienting profiles 60. In the example illustrated, the orienting key 76 is installed at the bottom or lead end of the alignment mechanism 34. As the orienting key 76 reaches the space between profiles 60, e.g. helical profiles, spring members 78 move the orienting key 76 radially outward so that it engages orienting profiles 60. The alignment mechanism 34, along with tool 32, is then stroked back and forth such that the interaction between orienting key 76 and profiles 60 causes rotation of the alignment mechanism 34/tool 22 relative to tubing string module 30. The back and forth motion is continued until the orienting key 76 is moved into an alignment slot 88 for proper alignment of tool 32. Use of the cooperating profiles 60 and the back and forth motion enables rotational orientation of the tool 32 when using a flexible conveyance 46, e.g. coil tubing, slick line, or other conveyances which have limited capability for rotational orientation through application of torque along the conveyance.

As the orienting key 76 is moved longitudinally into alignment slot 88, the key 36 is moved into the key profile 50. If the key profile 50 matches the locating key members 80 of key 36, the alignment mechanism 34 becomes locked at that particular location. If, on the other hand, the key 36 does not match the key profile 50, locking fails to occur and the alignment mechanism 34 may be moved to another location, e.g. to another lateral junction, for mating of the key 36 with the appropriate corresponding key profile 50. The locating key members 80 and the orienting key 76 may be mounted on spring members 82, 78, respectively, to enable radially inward contraction of the locating key members 80 and the orienting key 76 when sufficient longitudinal force is applied via conveyance 46.

Once the key 36 is locked in the corresponding key profile 50, a substantially higher, predetermined axial load is applied to release the latching key members 80 from the key profile 50 for movement, e.g. retrieval, of tool 32 and alignment mechanism 34 along tubing string 20. Application of the predetermined axial load, or a load level near the predetermined axial load, can be used to confirm and verify positive engagement of the key 36 with the proper corresponding key profile 50.

Figure 5:
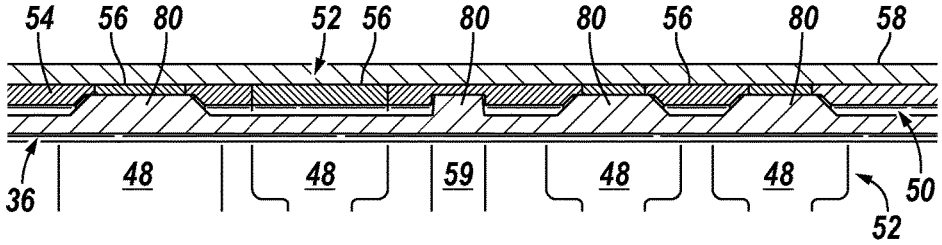
FIG. 5 is a cross-sectional view illustrating an example of a key profile created by insertion of a predetermined arrangement of profile inserts, according to an embodiment of the disclosure.
Figure 6:
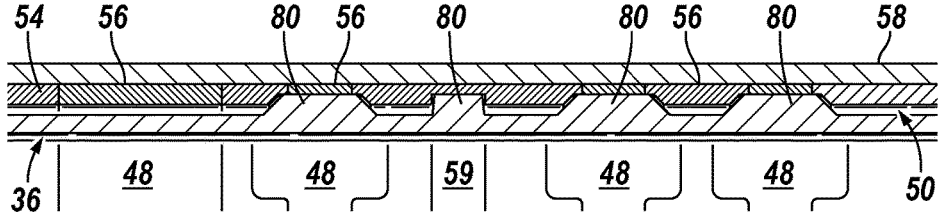
FIG. 6 is a cross-sectional view illustrating another example of a key profile created by insertion of a predetermined arrangement of profile inserts, according to an embodiment of the disclosure.
Figure 7:
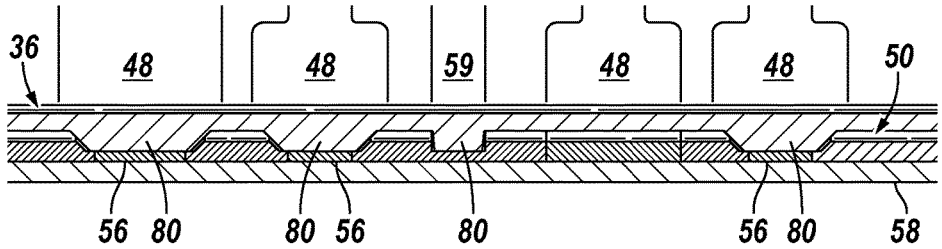
FIG. 7 is a cross-sectional view illustrating another example of a key profile created by insertion of a predetermined arrangement of profile inserts, according to an embodiment of the disclosure.

Referring generally to FIGS. 5-7, examples of different arrangements of profile inserts 48 are illustrated as establishing different key profiles 50. The profile inserts 48 may be selectively removed and interchanged with other profile inserts 48 to easily construct a variety of key profiles 50. In each of these examples, four profile inserts 48 are illustrated although other numbers of profile inserts 48 may be used to achieve the desired key profile 50. By way of illustration, the longitudinal key profile has been changed from the embodiment illustrated in FIG. 5 to that of FIG. 6 by interchanging the initial two left profile inserts 48 with other profile inserts. By way of further illustration, the circumferential key profile has been changed from the embodiment illustrated in FIG. 6 to that of FIG. 7 by again interchanging the two left profile inserts 48 (illustrated in FIG. 6) with other profile inserts (illustrated in FIG. 7). In these examples, the locating key members 80 do not extend around the circumference of the alignment mechanism 34 and thus may be used as circumferential locators to lock the tool 32 against rotational movement relative to the tubing module or section 30. In each of the examples illustrated, one of the locating key members 80 is received in annular groove 59 to provide support against axial loading.

Figure 8:
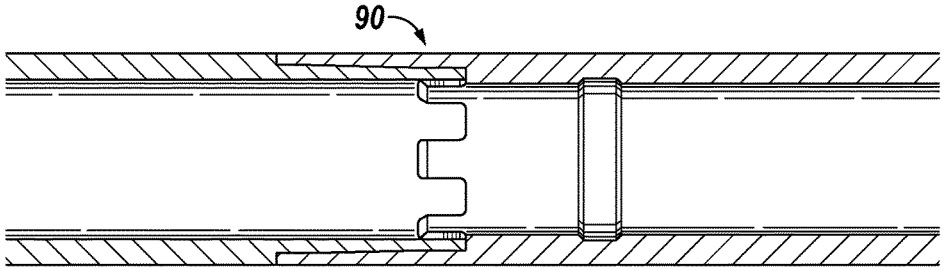
FIG. 8 is a cross-sectional view illustrating an engagement feature for engaging adjacent sections of a tubing module in the tubing string, according to an embodiment of the disclosure.

Depending on the application, various components, e.g. components within body 58, may be coupled together by a castellated connector 90, as illustrated in FIG. 8. The castellated connector 90 enables transfer of torque through the module 30 to, for example, the alignment mules 62, thus removing the need for welding. In this embodiment, the castellated connectors 90 may be non-symmetrical which facilitates assembly of the module components in a desired sequence and in a desired orientation. The use of castellated connectors 90 also facilitates the use of components which are relatively short in length and easier to manufacture. By connecting various sections with castellated connectors 90, the sections become modular and easy to interchange or replace instead of remanufacturing or replacing the entire unit.

In many applications, the key 36 and key profile 50 may be constructed with profile inserts 48 to provide acceptance of key 36 by key profile 50 in a single longitudinal position and a single rotational orientation. The embodiments illustrated in FIGS. 5-7, for example, employ longitudinal features 68 and circumferential features 70 to protect against false orientation. It should be noted that in the specific examples illustrated at least one of the profile inserts 48 is formed as a blank without a recess and without the longitudinal and circumferential features 68, 70. The arrangement of engagement features 66 ensures that tool 32 is ultimately latched in one predetermined alignment having a specific longitudinal position and rotational orientation. The design effectively protects against false landed positions. For example, if key 36 has three engagement features, even if the features are at non-uniform angles (versus equally spaced over 120°), at least two of the three features can still align in "false" landed positions. (See also FIG. 3). With four or more engagement features, the potential for false alignment only increases. However, forming at least one of the profile inserts 48 as a blank removes the potential for engagement in false landed positions.

If the tool 32 is not oriented to the desired angular orientation and is at a false orientation angle, the "blank" profile insert 48 prevents the radially outward movement of the corresponding locating key member 80 via spring member 82. The restriction of radially outward movement occurs because of the interference between the locating key member 80 and the "blank" profile insert 48 which does not have a recessed portion to receive the corresponding key member. Consequently, the key 36 cannot expand and latch with the adjacent key profile 50. The inability of the key 36 to latch with the adjacent key profile 50 can be confirmed by applying a tensile load to conveyance 46.

In some operations, a lack of rotational alignment can block latching of key 36 with key profile 50. In such event, the alignment mechanism 34 may simply be stroked up-and-down to move orienting key 76 along the cooperating profiles 60 until the key 36 and corresponding tool 32 are properly, rotationally oriented. Once in the desired rotational orientation, the key 36 can be moved longitudinally until locating key members 80 spring radially outwardly via spring members 82 to engage the key profile 50 established by profile inserts 48. If the key 36 remains unable to latch with key profile 50, the alignment mechanism 34 and tool 32 may be moved farther along the interior 44 of the tubing string 20 until reaching the proper latching section 40. Once properly latched, an operator can verify that tool 32 is at the desired location, e.g. desired junction 28, by applying tensile loading on conveyance 46. If the tensile loading passes a predetermined level, the operator is assured that key 36 has latched with the proper key profile 50. This process can be used in, for example, multilateral well applications to ensure tool 32 is properly oriented at the desired lateral junction.

Depending on the application, the tubing string 20, tubing module 30, tool 32, and alignment assembly 34 may be constructed in several configurations. For example, many types of tools may be coupled to the alignment assembly/mechanism via various types of connector ends. Additionally, many sizes and configurations of profile inserts may be interchangeably coupled with the latching section 40 via various coupling mechanisms. The key may be constructed in different sizes and configurations and such keys may be spring biased via a variety of springs. In multilateral well applications, the key profile may be different for each lateral bore junction and thus the profile inserts and corresponding locating key members can be arranged to match a specific, selected multilateral junction. The materials used to form the tool, the alignment mechanism, and the tubing string components may be of many different types and combinations depending on the specifics of a given application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for latching, comprising:

a tubing string having a latching section for latching a tool in a specific orientation, the latching section having a plurality of mounting regions; and a plurality of profile inserts releasably engaged with the plurality of mounting regions to enable interchanging of selected profile inserts with other profile inserts of the plurality of profile inserts, the plurality of profile inserts having different combinations of longitudinal engagement features and circumferential engagement features arranged to establish a key profile for engagement with a corresponding key associated with the tool, the key profile being established in a longitudinal direction and a circumferential direction so as to accept the corresponding key at a single longitudinal and rotational position of the tool, wherein the tubing string comprises an orientation section to rotationally orient the corresponding key for receipt in the latching section, wherein the orientation section comprises a pair of orienting profiles, and wherein the tool is associated with an orientation feature that is configured to cycle back and forth in a space between the pair of orienting profiles of the orientation section until the orientation feature and the tool are rotationally oriented.

2. The system as recited in claim 1, wherein the plurality of profile inserts comprises at least three profile inserts.

3. The system as recited in claim 1, wherein the plurality of profile inserts comprises at least four profile inserts.

4. The system as recited in claim 1, wherein the plurality of mounting regions comprises a plurality of openings sized to receive the plurality of profile inserts.

5. The system as recited in claim 1, wherein the latching section comprises an annular groove to provide support against axial loading.

6. The system as recited in claim 1, wherein the pair of orienting profiles is carried by a pair of alignment mules oriented such that the pair of orienting profiles face each other.

7. The system recited in claim 6, wherein the pair of orienting profiles are mirror images of each other.

8. The system as recited in claim 1, wherein the latching section and the orientation section are located in a tubing string module of a multilateral well completion.

9. A method, comprising:

providing a tool and a key for latching the tool at a desired location in a tubing string;

selecting a plurality of interchangeable profile inserts, the plurality of interchangeable profile inserts having different combinations of longitudinal engagement features and circumferential engagement features;

releasably positioning the plurality of interchangeable profile inserts into a latch section of the tubing string to establish a key profile matching the key;

forming the plurality of interchangeable profile inserts with longitudinal and circumferential features arranged to accept the key in a specific longitudinal and rotational position;

rotationally orienting the tool via a pair of alignment mules having facing orienting profiles, wherein the tool is associated with an orientation feature that is configured to cycle back and forth in a space between the pair of alignment mules until the orientation feature and the tool are rotationally oriented; and conveying the tool along an interior of the tubing string until the key latches into the key profile.

10. The method as recited in claim 9, further comprising changing the key profile by interchanging at least one of the interchangeable profile inserts with a different interchangeable profile insert.

11. The method as recited in claim 9, further comprising establishing a different key profile at each latching section of a plurality of the latching sections provided at different locations along the tubing string.

12. The method as recited in claim 9, wherein providing comprises providing an intervention tool; and conveying comprises conveying the intervention tool into a multilateral completion via a flexible conveyance.

13. A method, comprising:

establishing a key profile at a lateral junction of a multilateral completion tubing string by mounting a plurality of interchangeable profile inserts in a latch section of the multilateral completion tubing string, the plurality of interchangeable profile inserts having different combinations of longitudinal engagement features and circumferential engagement features;

coupling an intervention tool with a key matching the key profile;

conveying the intervention tool through the multilateral completion tubing string; and latching the key with the key profile, wherein establishing comprises establishing the key profile in a manner which latches the key longitudinally and rotationally, wherein coupling comprises rotationally orienting the intervention tool via a pair of alignment mules having facing orienting profiles, and wherein the intervention tool is associated with an orientation feature that is configured to cycle back and forth in a space between the pair of alignment mules until the orientation feature and the intervention tool are rotationally oriented.

14. The method as recited in claim 13, further comprising rotating the intervention tool until the key is rotationally aligned with the key profile and then moving the key longitudinally into engagement with the key profile.

* * * * *